US005537969A

United States Patent [19]

Hata et al.

[11] Patent Number: 5,537,969

[45] Date of Patent: Jul. 23, 1996

[54] CYLINDER BLOCK

[75] Inventors: Tsunehisa Hata; Hideo Shimizu; Kenji Matsumoto, all of Saitama, Japan

[73] Assignee: Honda Giken Kogyo Kabushiki Kaisha, Tokyo, Japan

[21] Appl. No.: 423,294

[22] Filed: Apr. 18, 1995

[30] Foreign Application Priority Data

Apr. 20, 1994 [JP] Japan ..... 6-081218

[51] Int. Cl.[6] ..... F02F 1/00; B22D 19/00

[52] U.S. Cl. ..... 123/193.2; 123/41.84

[58] Field of Search ..... 123/193.2, 193.3, 123/41.84, 41.83; 29/888.06, 888.061

[56] References Cited

U.S. PATENT DOCUMENTS

| | | | |
|---|---|---|---|
| 2,879,116 | 3/1959 | Goetze | 123/41.84 |
| 4,202,310 | 5/1980 | Zorrilla | 123/41.84 |
| 4,447,275 | 5/1984 | Hiraoka et al. | 123/41.84 |
| 4,616,603 | 10/1986 | Kubis | 123/193.2 |
| 5,148,780 | 9/1992 | Urano | 123/193.2 |
| 5,402,754 | 4/1995 | Gunnarsson | 123/193.2 |

FOREIGN PATENT DOCUMENTS 57-13391 3/1982 Japan .

*Primary Examiner*—Marguerite McMahon
*Attorney, Agent, or Firm*—Lyon & Lyon

[57] ABSTRACT

A cylinder block is produced by subjecting an outer surface of a cylinder sleeve section Sc of cast iron to a shot blast treatment, forming a first intermediate layer 31 of aluminum-based material containing Si, Cu and the like on the cylinder section Sc, and inserting the cylinder sleeve section Sc in a cast-in manner within a cylinder barrel $\mathbf{1}_U$ of aluminum alloy. The electrical-potential difference between the cylinder sleeve section Sc and the cylinder barrel $\mathbf{1}_U$ and the first intermediate layer 31 is decreased by the first intermediate layer 31 to enhance the durability against an electrolytic corrosion and to enhance the deposition by a mutual diffusing action therebetween. In a modification, a second intermediate layer 32 of a Ni-Al based material is formed under the first intermediate layer 31 at a portion of the cylinder sleeve section Sc inserted in a cast-in manner within the cylinder barrel $\mathbf{1}_U$, whereby the adhesion can be further enhanced.

9 Claims, 7 Drawing Sheets

CYLINDER BLOCK

BACKGROUND OF THE INVENTION

FIELD OF THE INVENTION

The present invention relates to a cylinder block of a wet liner type including a cylinder sleeve section of an iron-based material inserted in a cast-in manner within a cylinder barrel of aluminum-based material.

DESCRIPTION OF THE PRIOR ART

In general, a cylinder block of a wet liner type for an internal combustion engine is produced by inserting a cylinder sleeve section of cast iron in a cast-in manner into a cylinder barrel of aluminum alloy. The thermal expansion coefficients of the cast iron and the aluminum alloy are very different and for this reason, the adhesion between the cylinder sleeve section and the cylinder barrel may be damaged in some cases by heat or vibration generated with the operation of the internal combustion engine thereby resulting in a separation therebetween.

A cylinder block is known in which, in order to eliminate such a disadvantage, a cylinder sleeve section having an unevenness by depositing iron or molybdenum in a granular fashion onto an outer surface thereof by flame spray coating is inserted in a cast-in manner within a cylinder barrel, thereby enhancing the adhesion between the cylinder sleeve section and the cylinder barrel (See Japanese Utility Model Publication No. 13391/82).

However, the above prior art cylinder block suffers from a problem that the cylinder barrel of the aluminum alloy is in contact with iron or molybdenum which is a different metal and for this reason, an electrical-potential difference is generated at an interface therebetween, so that a so-called electrolytic corrosion is liable to occur. There is also a problem that the enhancement of the adhesion is based on a wedge effect produced by the aluminum alloy flowing into the uneven portion formed by the flame spray coating onto the cylinder sleeve section and for this reason, a sufficient adhesion is not necessarily obtained.

SUMMARY OF THE INVENTION

Accordingly, it is an object of the present invention to prevent the electrolytic corrosion produced at the interface between the cylinder sleeve section and the cylinder barrel and to enhance the adhesion between both of them.

To achieve the above object, according to the present invention, there is provided a cylinder block of a wet liner type, comprising a cylinder sleeve section made of iron-based material inserted in a cast-in manner within a cylinder barrel made of aluminum-based material, the cylinder block further including an intermediate layer made of aluminum-based material provided on a contact surface of an outer periphery of the cylinder sleeve section in contact with the cylinder barrel and on another contact surface of the outer periphery in contact with cooling water.

With the above construction, the adhesion between the cylinder sleeve section and the cylinder barrel is enhanced to substantially improve the reliability against peel-off. In addition, the electrical-potential difference between the cylinder sleeve section and the cylinder barrel is decreased to provide an enhanced durability against the electrolytic corrosion and moreover, the wear resistance and the heat dissipation of the portion of the cylinder sleeve section in contact with the cooling water are enhanced.

If a second intermediate layer of nickel-aluminum based material is provided between the outer periphery of the cylinder sleeve section and the intermediate layer, the intermediate layer can be more firmly adhered to the outer periphery of the cylinder sleeve section to further firmly couple the cylinder sleeve section and the cylinder barrel.

If the second intermediate layer is formed only on the portion of the outer periphery of the cylinder sleeve section inserted in a cast-in manner within the cylinder barrel, a reduction in heat dissipation due to the second intermediate layer can be avoided, while still insuring the improved adhesion between the cylinder sleeve section and the cylinder barrel.

The above and other objects, features and advantages of the invention will become apparent from the following description of the preferred embodiments taken in conjunction with the accompanying drawings.

BRIEF DESCRIPTION OF THE DRAWINGS

FIGS. 1 to 6 illustrate a first embodiment of the present invention, wherein FIG. 1 is a plan view of a cylinder block;

FIG. 2 is a sectional view taken along a line 2—2 in FIG. 1;

FIG. 3 is a sectional view taken along a line 3—3 in FIG. 1;

FIG. 4 is a sectional view taken along a line 4—4 in FIG. 1;

FIG. 5 is an enlarged view of a portion indicated by the oval 5 in FIG. 3;

FIG. 6 is a sectional view of a mold;

DESCRIPTION OF THE PREFERRED EMBODIMENTS

Figure 1:
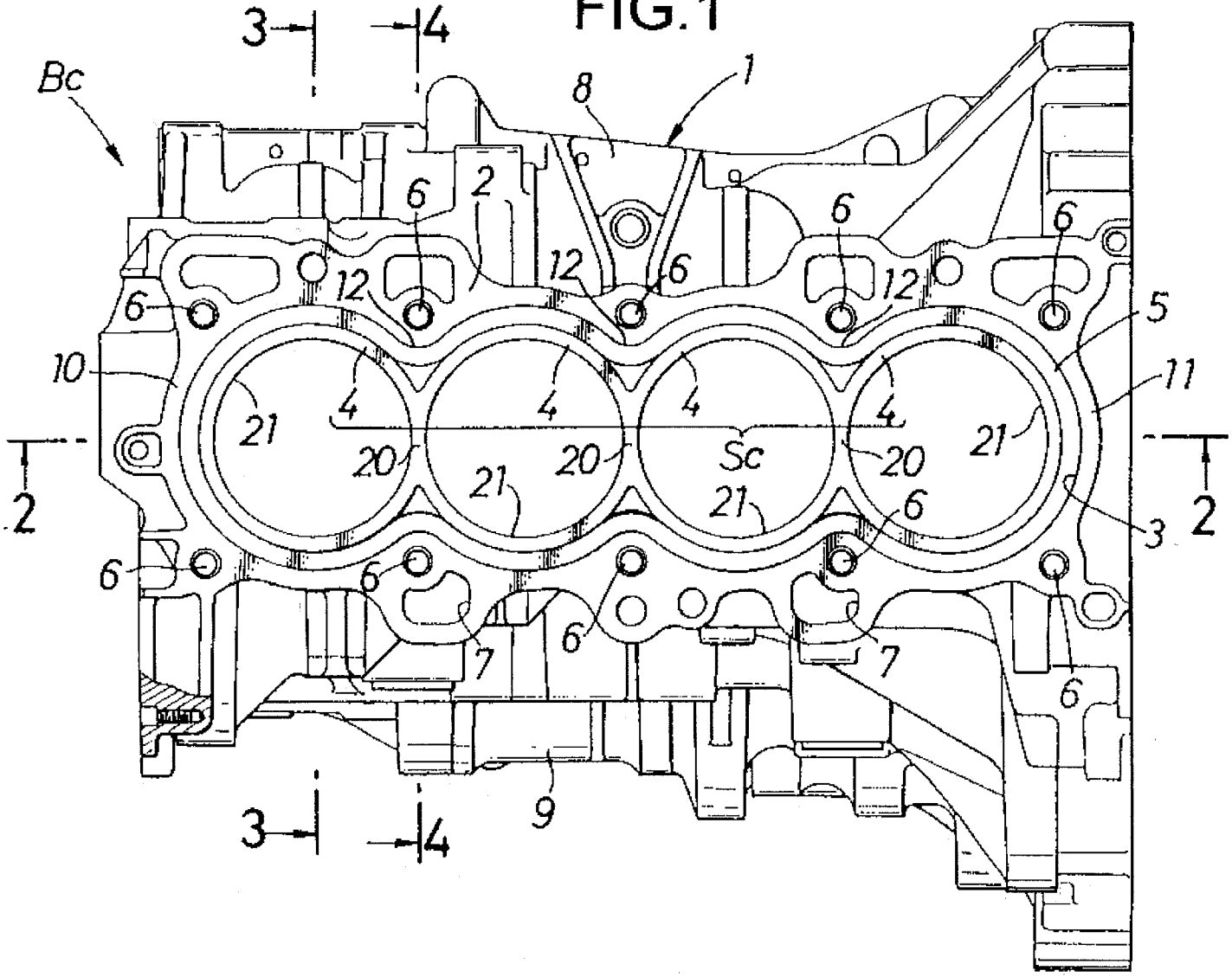
Figure 2:
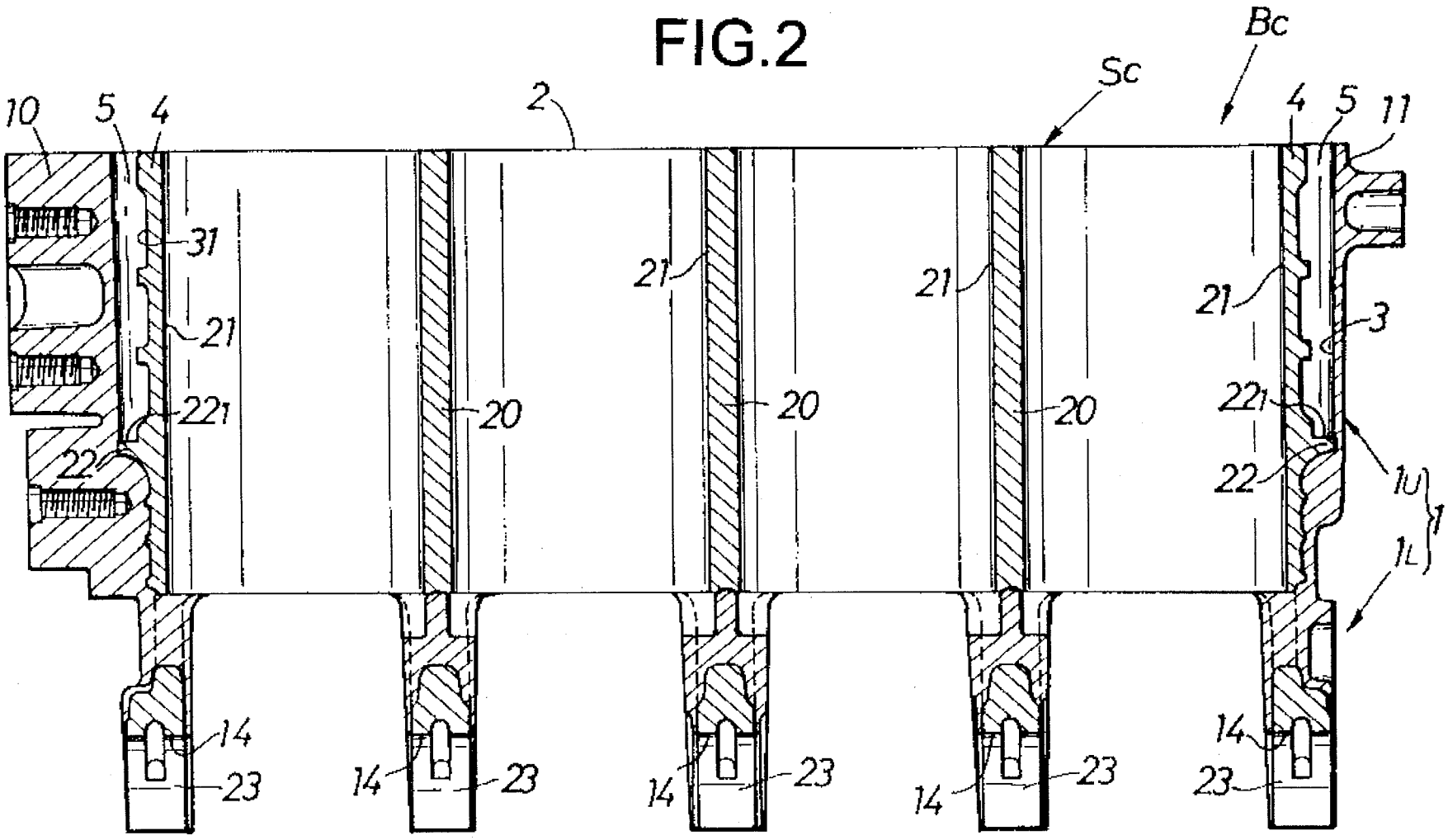
Figure 3:
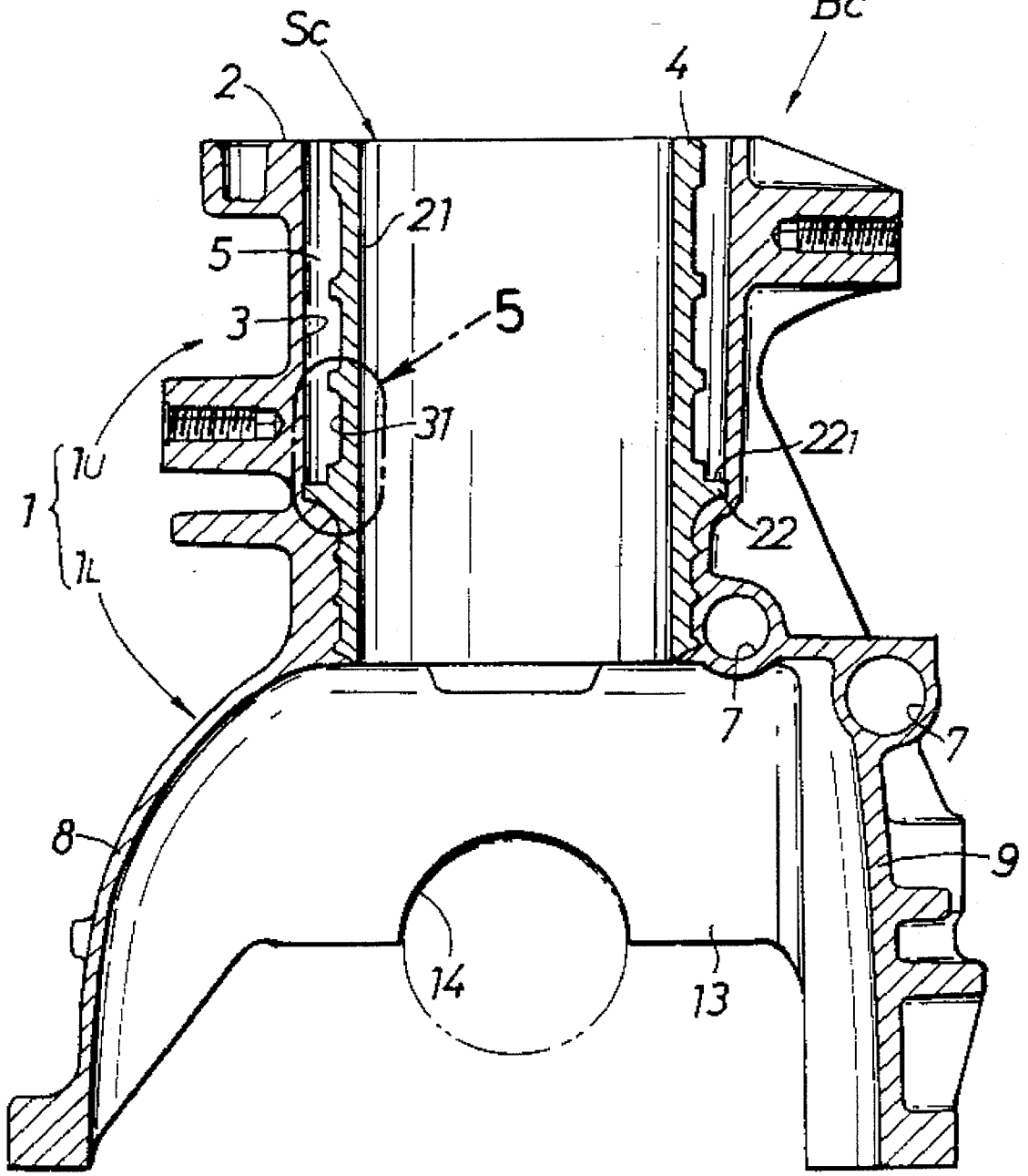
Figure 4:
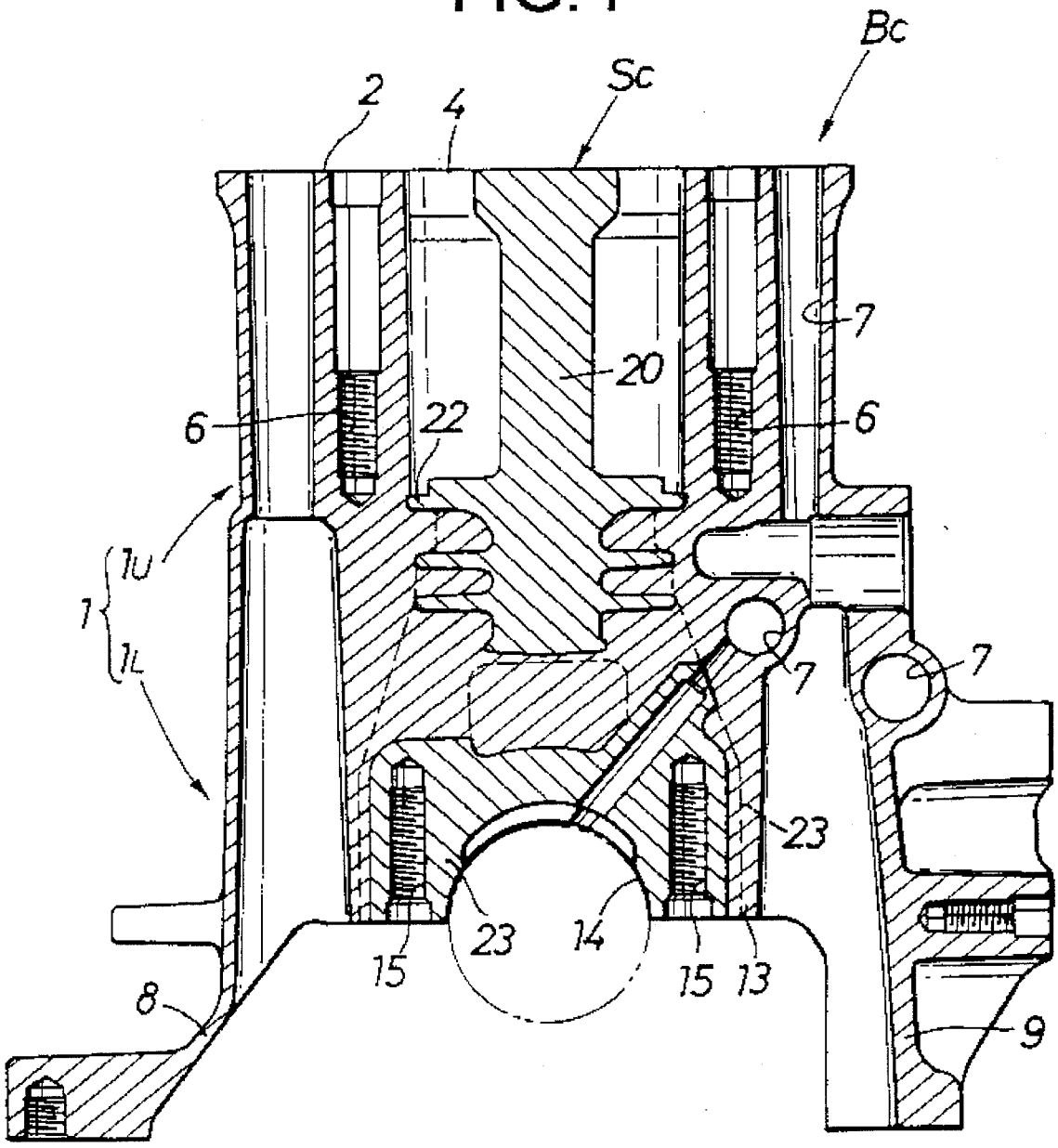

The present invention will now be described by way of preferred embodiments in connection with the accompanying drawings.

Referring to FIGS. 1 to 4, a cylinder block Bc for a serial 4-cylinder internal combustion engine is constructed as an open deck type having a four-series wet-type cylinder sleeve section Sc. A cylinder block body 1 constituting a main portion of the cylinder block Bc is formed by a die-casting of aluminum alloy.

The cylinder block body 1 includes an upper portion, i.e., a cylinder barrel $\mathbf{1}_U$, and a lower portion, i.e., a crankcase $\mathbf{1}_L$. Four-series barrel bore 3 is provided in the upper portion $\mathbf{1}_U$ and opens into a deck surface 2 of the cylinder block body 1. The cylinder sleeve section Sc of cast iron is integrally formed in a cast-in manner in the barrel bore 3. The cylinder sleeve section Sc includes four cylinder sleeves 4 connected in series. A piston, which is not shown, is slidably received in each of the sleeves 4.

A water jacket 5 is formed between an outer wall surface of the cylinder sleeve section Sc and an inner wall surface of the barrel bore 3 and opens into the deck surface 2. Cooling water is circulated through the water jacket 5.

An outer wall of the cylinder barrel $1_U$ is provided with conventional bolt bores 6 used for mounting a cylinder head (not shown) on the deck surface 2, an oil passage 7 through which a lubricating oil flows, and the like.

The crankcase $1_L$ constituting the lower portion of the cylinder block body 1 includes left and right skirt walls 8 and 9 integrally extending downwardly from a lower portion of the cylinder barrel $1_U$, and a plurality of bearing walls 13 provided to extend downwardly from constrictions 12 between the sleeves 4 and lengthwise opposite walls 10 and 11 of the cylinder barrel $1_U$ to integrally connect the left and right skirt walls 8 and 9. Reinforcing walls 23 are integrally formed in the cylinder sleeve Sc and inserted in a cast-in manner in the bearing walls 13, respectively, and a conventional semi-circular bearing bore 14 for a crankshaft, a pair of bolt bores 15 or the like used for mounting a bearing cap (not shown) on a lower surface of the semi-circular bearing bore 14, and the like, are defined in each of the reinforcing walls 23.

The cylinder sleeve section Sc is formed of the four cylindrical sleeves connected to one another, with the adjacent sleeves 4 being interconnected through a common boundary wall 20. Thus, the cylinder sleeve section Sc is formed in a so-called Siamese type. A cylinder bore 21 with the piston (not shown) slidably received therein is defined in each of the sleeves 4.

A seal flange 22 is integrally provided around the entire outer periphery of a lower portion of .the cylinder sleeve section Sc to extend substantially horizontally in a direction substantially perpendicular to the axis of the cylinder. An upper surface of the seal flange 22 is formed into a flat seal surface $22_1$, so that a free end of a jacket pin 45, for shaping the water jacket, of a die-casting mold M (which will be described hereinafter) can be mated in a molten metal-tight manner onto the seal surface $22_1$.

Figure 5:
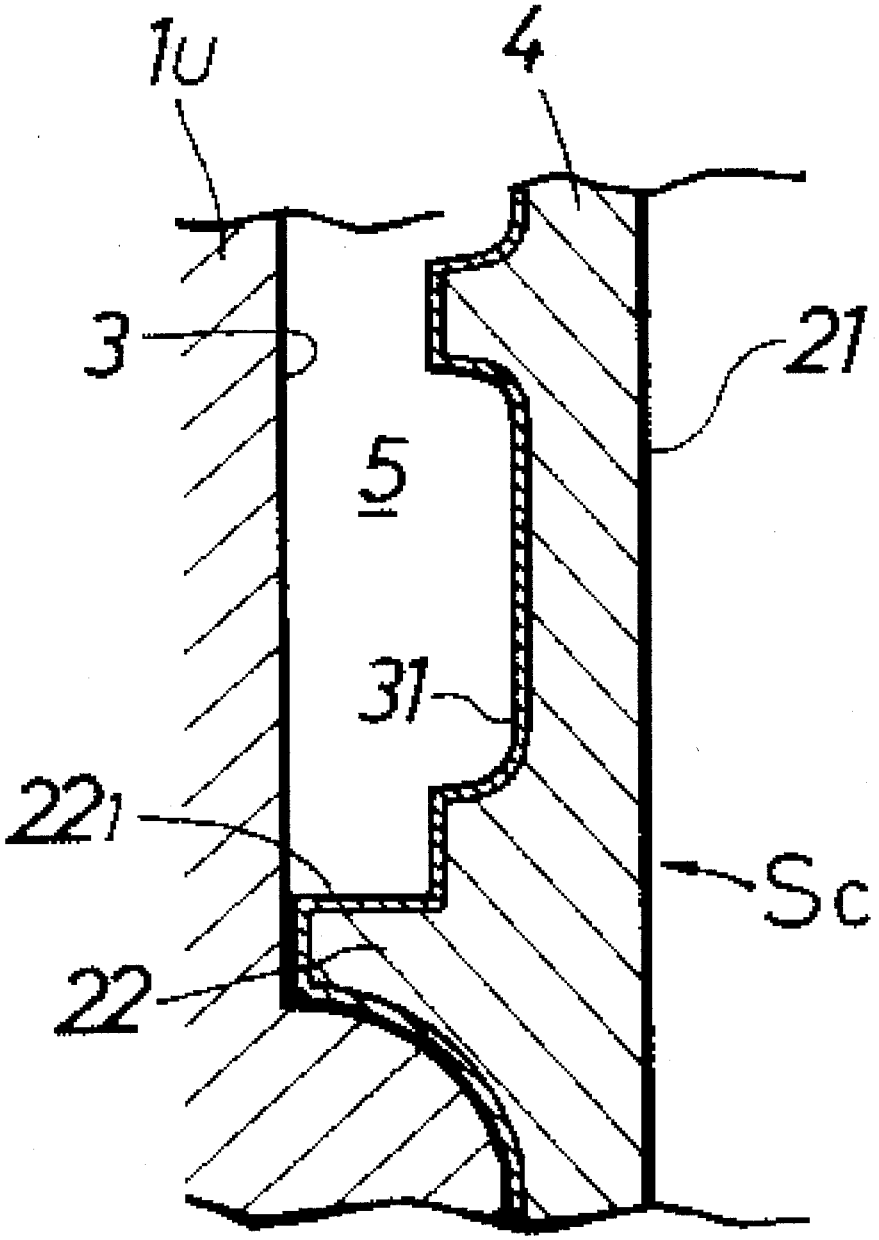

Referring to FIG. 5, the material for the cylinder block body 1 including the cylinder barrel $1_U$ is a die-casting aluminum alloy (ADC12) having a composition which by % weight comprises 18 to 90% of aluminum (Al), 9.6 to 12% of silicon (Si), 1.3 to 3.5% of copper (Cu), 0.3% or less of magnesium (Mg), 1.0% or less of zinc (Zn), 1.3% or less of iron (Fe), 0.5% or less of manganese (Mn), 0.5% or less of nickel (Ni) and 0.3% or less of tin (Sn). The material for the cylinder sleeve section Sc is a gray cast iron (FC250). An intermediate layer 31 is formed on the outer surface of the cylinder sleeve section Sc from an aluminum-based material having a composition which by % weight comprises 80 to 90% of aluminum (Al), 4 to 13% of silicon (Si), 0.5 to 6% of copper (Cu), with one to four elements selected from Ag, Zn, Fe, Cr, Be, Li, Mn, Ti and Sb being each added in an amount of 0.9% or less.

The intermediate layer 31 includes a flame spray coating layer of a brazing aluminum material having the above-described composition and formed in the following procedure. First, contaminants such as oxide scale, rust and the like on the surface are removed by subjecting the outer surface of the cylinder sleeve section Sc to a shot blast, and a very small unevenness is formed on the surface. Then, the brazing aluminum material is sprayed onto the outer surface of the cylinder sleeve section Sc by a flame spray gun to form the intermediate layer 31. At this time, the intermediate layer 31 is firmly coupled to the outer surface of the cylinder sleeve section Sc by virtue of an increase in surface area and a wedge effect provided by the very small unevenness formed by the shot blast.

Figure 6:
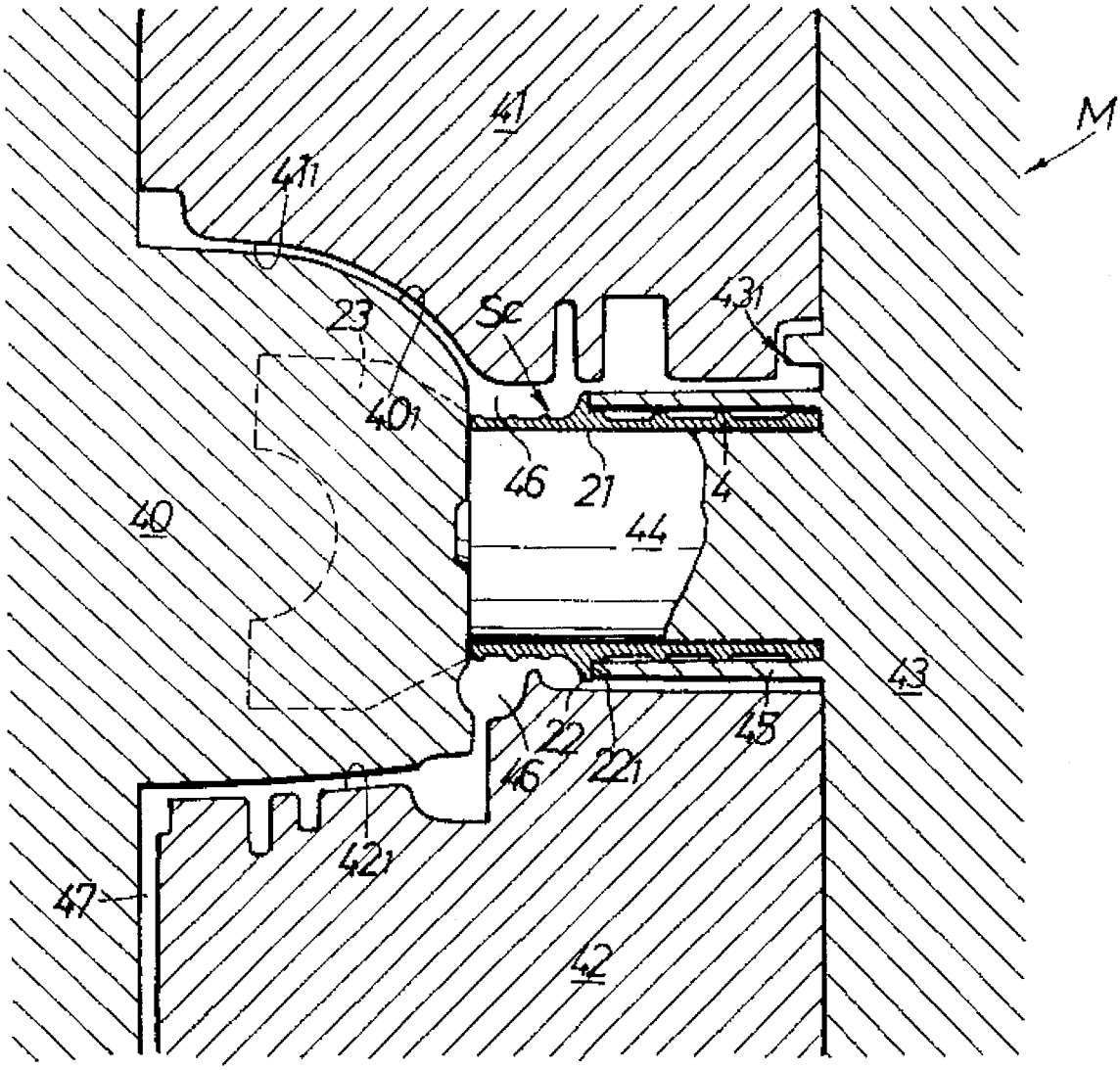

The mold for die-casting the cylinder block Bc will be described below with reference to FIG. 6.

The die-casting mold M includes a stationary die 40, left and right movable side dies 41 and 42 movable laterally toward and away from each other, and an upper movable die 43 liftable and lowerable relative to the stationary die 40. The stationary die 40 is formed with a convex forming surface $40_1$, and the left and right movable side dies 41 and 42 are formed with forming surfaces $41_1$ and $42_1$ in an opposed relation to the surface $40_1$ and to each other, respectively. The upper movable die 43 is formed with a forming surface $43_1$ in an opposed relation to the forming surface $40_1$ of the stationary die 40. Cylindrical bore pins 44 for forming the cylinder bores 21 are integrally provided in a longitudinal arrangement on the forming surface $43_1$ to depend therefrom, and a hollow cylindrical jacket pin 45 is also integrally provided in a hanging manner on the forming surface $43_1$ to surround the bore pins 44 with an annular clearance left therebetween. The jacket pin 45 extends to-an intermediate portion of the bore pins 44.

The cylinder sleeve section Sc having the intermediate layer 31 is fitted over an outer periphery of each of the bore pins 44, and the jacket pin 45 is fitted over the outer periphery of the cylinder sleeve section Sc. A free end of the jacket pin 45 is mated onto the seal surface $22_1$ of the seal flange 22 and has a mating surface which is formed into a seal surface that is tight against molten metal, so that the molten metal is prevented from flowing therethrough during casting.

A cavity 46 is defined by a molding surface of the mold M and the cylinder sleeve section Sc. If a molten aluminum alloy is injected under a predetermined pressure through a sprue 47 into the cavity 46 and then cooled, the cylinder block Bc is molded with the cylinder sleeve section Sc integrally inserted in a cast-in manner in an aluminum alloy matrix.

As described above, the cylinder sleeve section Sc has been inserted in a cast-in manner after formation of the intermediate layer 31 of the aluminum-based material on the outer surface of the cylinder sleeve section Sc and therefore, a mutual diffusion is produced between the intermediate layer 31 and the cylinder barrel $1_U$, thereby causing the cylinder sleeve section Sc and the cylinder barrel $1_U$ to be firmly coupled to each other, leading to a substantially increased reliability against the peel-off.

Moreover, because the intermediate layer 31 formed on the outer surface of the cylinder sleeve section Sc and the cylinder barrel $1_U$ are of the same type of the aluminum-based metal, an electrical-potential difference between the cylinder sleeve section Sc and the cylinder barrel $1_U$ is decreased, thereby bringing about an increased durability.

Further, the corrosion resistance and the heat dissipation of a portion of the outer surface of the cylinder sleeve section Sc opposed to the water jacket 5 are enhanced by the intermediate layer 31. More specifically, if the intermediate layer 31 is not provided, the entire outer surface of the cylinder sleeve section. Sc of an iron-based material will be corroded by the contact thereof with cooling water; however, the outer surface of the intermediate layer 31 of the aluminum-based material is formed in a pitted state and therefore, a reduction in heat dissipation due to the corrosion is prevented.

Figure 7:
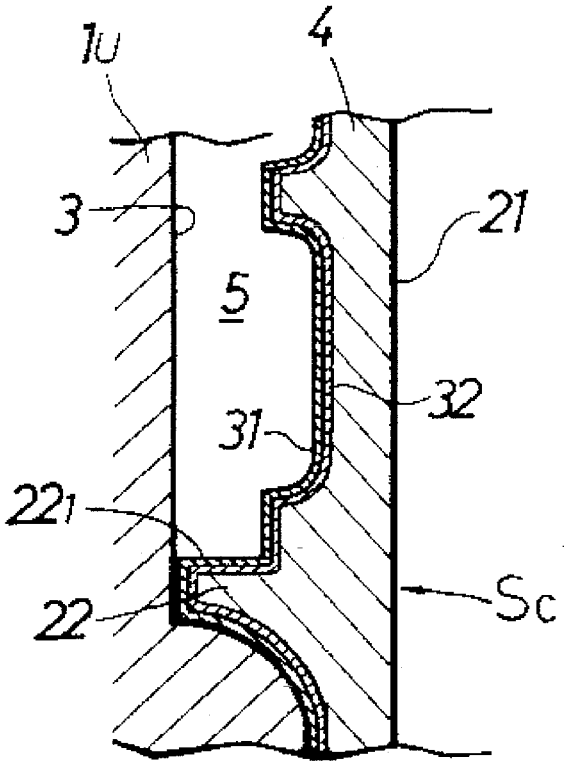
FIG. 7 is a sectional view similar to FIG. 5, but illustrating a second embodiment of the present invention.

A second embodiment of the present invention will now be described with reference to FIG. 7.

The second embodiment has a feature in that a second intermediate layer 32 is provided under the intermediate layer 31. More specifically, the second intermediate layer 32 is formed by subjecting the outer surface of the cylinder sleeve section Sc to a shot blast and then spraying a nickel-aluminum material having a composition comprising, by weight %, 80% of nickel (Ni) and 20% of aluminum (Al) by a flame spray gun, and a first intermediate layer 31 similar to the intermediate layer 31 in the first embodiment is formed on an outer surface of the second intermediate layer 32.

When the nickel-aluminum material is sprayed by the flame spray gun, nickel and aluminum contained in droplets colliding against the outer surface of the cylinder sleeve section Sc exothermically react with each other to form a nickel aluminide as an intermetallic compound. And such nickel aluminide is then diffused to penetrate the cylinder sleeve section Sc, thereby forming an unevenness on the surface as a surface preparation layer. Therefore, the first intermediate layer 31 sprayed on the uneven surface can be firmly adhered to the outer surface of the cylinder sleeve section Sc. As a result, the adhesion between the cylinder sleeve section Sc and the cylinder barrel $\mathbf{1}_U$ is further enhanced, so that they are further firmly coupled to each other.

The second embodiment is particularly advantageous if it is applied to a diesel engine which generates large vibration, because the cylinder sleeve section Sc and the cylinder barrel $\mathbf{1}_U$ can be firmly coupled to each other.

Figure 8:
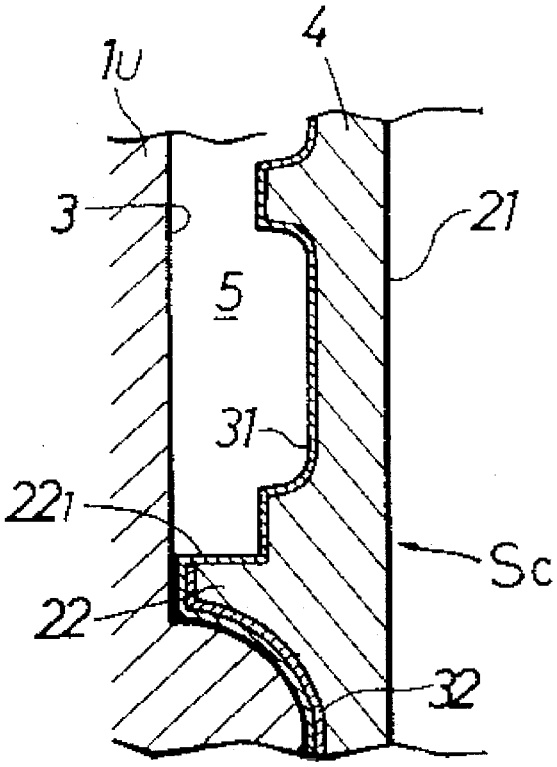
FIG. 8 is a sectional view similar to FIG. 5, but illustrating a third embodiment of the present invention.

A third embodiment of the present invention will now be described with reference to FIG. 8.

The third embodiment has a feature that an intermediate layer 32 similar to that in the second embodiment is formed only on the portion of the cylinder sleeve section Sc inserted in a cast-in manner within the cylinder barrel $\mathbf{1}_U$, but is not formed on the portion opposed to the water jacket 5. More specifically, the portion of the cylinder sleeve section Sc opposed to the water jacket 5 does not participate in the desired adhesion, because it is not inserted in the cast-in manner within the cylinder barrel $\mathbf{1}_U$, and therefore that portion need not include the second intermediate layer 32. Moreover, the second intermediate layer 32 of nickel aluminide has a low heat conductivity and hence, a reduction in heat dissipation can be avoided by omission of the second intermediate layer 32 on the portion opposed water jacket 5. The adhesion of the portion of the cylinder sleeve section Sc inserted in the cast-in manner within the cylinder barrel $\mathbf{1}_U$ can be enhanced by the presence of the second intermediate layer 32 and the first intermediate layer 31 as in the second embodiment. It should be noted that the corrosion resistance and the heat dissipation in the second and third embodiments are enhanced as in the first embodiment by forming the first intermediate layer 31 in an opposed relation to the water jacket 5.

The third embodiment is particularly advantageous, if it is applied to a high-output engine, because of the excellent adhesion between the cylinder sleeve section Sc and the cylinder barrel $\mathbf{1}_U$ and the excellent dissipation of heat from the cylinder sleeve section Sc to the cooling water.

Although the embodiments of the present invention have been described in detail, it will be understood that the present invention is not limited to the above-described embodiments, and various modifications in design may be made without departing from the spirit and scope of the invention defined in claims.

For example, the intermediate layer 31 (the first intermediate layer 31) of the aluminum-based material is described as being formed by flame spray coating in the embodiments; however, in addition to the flame spray coating, any appropriate means such as a plating can be employed. When a die-casting under a high molten metal injection pressure is carried out, it is possible that the intermediate layer formed by a plating may be eroded and for this reason, it is desirable that the intermediate layer is formed by the flame spray coating as in the embodiments. However, when a gravity casting is carried out, the formation of the intermediate layer by plating may be utilized. The portion of the cylinder sleeve section Sc that is exposed to the water jacket may be protected by materials and processes other than layer 31. The second intermediate layer 32 may be of any material and/or process that improves the surface preparation of the cylinder sleeve material for adhering the first intermediate layer. Of course, the present invention is also applicable to a cylinder block Bc having a number of cylinders other than four cylinders, and a cylinder block Bc of a type other than the Siamese type.

What is claimed is:

1. A cylinder block of a wet liner type, comprising a cylinder sleeve section of an iron-based material inserted in a cast-in manner within a cylinder barrel of an aluminum-based material, said cylinder block further including an intermediate layer of an aluminum-based material provided on a contact surface of an outer periphery of said cylinder sleeve section in contact with said cylinder barrel and on a contact surface of the outer periphery in contact with cooling water.

2. A cylinder block according to claim 1, further including a second intermediate layer of a nickel-aluminum based material provided between the outer periphery of said cylinder sleeve section and said intermediate layer.

3. A cylinder block according to claim 2, wherein said second intermediate layer is formed only on a portion of the outer periphery of said cylinder sleeve section inserted in a cast-in manner within said cylinder barrel.

4. A cylinder block of a wet liner type, comprising a cylinder barrel of an aluminum-based material, a cylinder sleeve of an iron-based material mounted in a cast-in manner in said cylinder barrel, an intermediate layer of an aluminum-based brazing material provided on at least a contact surface portion of an outer periphery of said cylinder sleeve in cast-in contact with said cylinder barrel.

5. A cylinder block according to claim 4, further including a surface preparation layer between said surface portion of said outer periphery of said cylinder sleeve and said intermediate layer, said surface preparation layer being of a material for improving adhesion of said intermediate layer to said cylinder sleeve.

6. A cylinder block according to claim 4, wherein said intermediate layer also is formed on a portion of said outer periphery of said cylinder sleeve that forms a portion of a water jacket in the cylinder block.

7. A cylinder block according to claim 1, 2, 3, 4, 5 or 6, wherein said intermediate layer is comprised of aluminum (A) in a range of $80\% \geqq A \geqq 90\%$, silicon (Si) in a range of $4\% \geqq Si \geqq 13\%$, copper (cu) in a range of $0.5\% \geqq Cu \geqq 6\%$, and one to four elements selected from Ag, Zn, Fe, Cr, Be, Li, Mn, Ti and Sb in an amount $\leqq 0.9\%$.

8. A cylinder block according to claim 1, 2, 3, 4, 5 or 6, wherein said outer periphery is shot blasted before applying said intermediate layer.

9. A cylinder block according to claim 8, wherein said intermediate layer is applied to said outer periphery by flame spraying.

* * * * *